United States Patent [19]

Wingert

[11] 4,257,159

[45] Mar. 24, 1981

[54] METHOD FOR SECURING WIRES TO SCREW TERMINALS

[76] Inventor: Louis E. Wingert, 1525 Riverdale Ave., Appleton, Wis. 54911

[21] Appl. No.: 954,860

[22] Filed: Oct. 26, 1978

[51] Int. Cl.[3] ..... H01R 43/04

[52] U.S. Cl. ..... 29/861; 7/108; 140/104; 140/106

[58] Field of Search ..... 29/628, 758; 7/107, 7/108, 165; 140/104, 102.5, 106, 124

[56] References Cited

U.S. PATENT DOCUMENTS

| | | | |
|---|---|---|---|
| 789,941 | 5/1905 | Sibley | 7/107 |
| 2,430,119 | 11/1947 | Frank | 140/124 |
| 2,546,489 | 3/1951 | Wright | 140/124 |
| 3,095,912 | 7/1963 | Sullivan | 140/124 X |
| 3,253,286 | 5/1966 | Bacon | 7/108 |
| 4,060,305 | 11/1977 | Poliak et al. | 29/758 X |

*Primary Examiner*—Francis S. Husar
*Assistant Examiner*—C. J. Arbes
*Attorney, Agent, or Firm*—Kane, Dalsimer, Kane, Sullivan and Kurucz

[57] ABSTRACT

A method is disclosed for securing a wire to a screw terminal. A wire is inserted within an aperture of a hollow shaft, and a loop is formed by turning either the wire or the shaft. The loop will have a substantially straight end portion when formed in this matter. The loop is placed about the shank portion of a screw terminal, after which it is closed by a notch of an appropriately shaped tool. The screw may then be tightened in a conventional manner.

9 Claims, 12 Drawing Figures

Fig.5
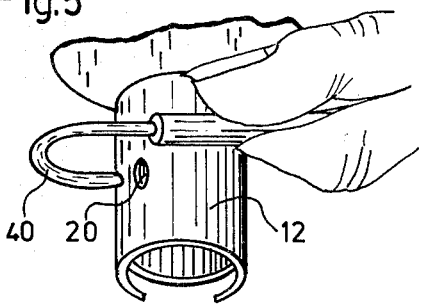
Fig. 7
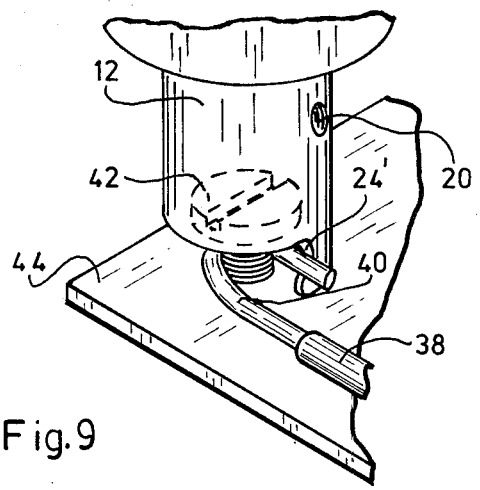
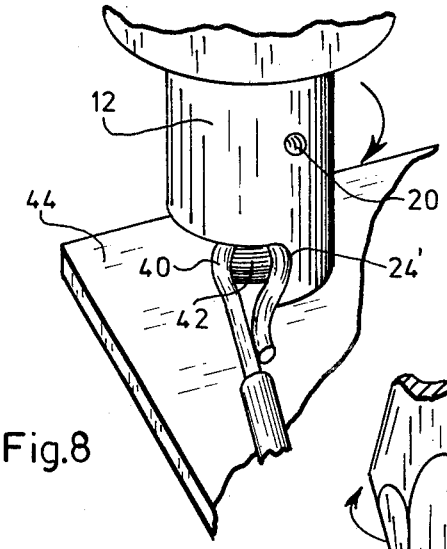
Fig.8
Fig.9
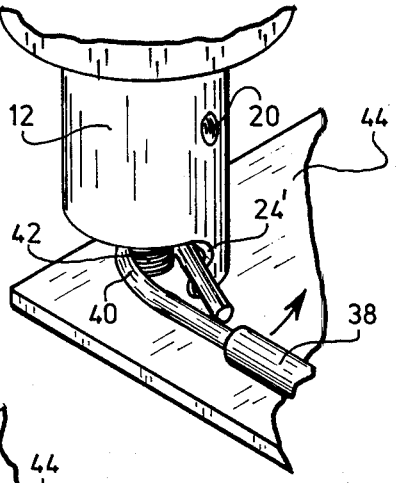
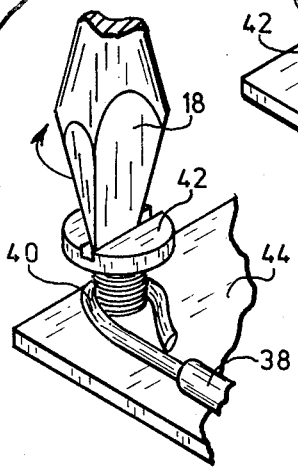
Fig.10
Fig.11
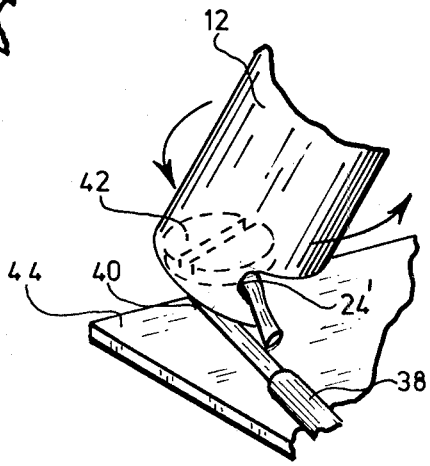

METHOD FOR SECURING WIRES TO SCREW TERMINALS

BACKGROUND OF THE INVENTION

The field of the invention relates to methods for securing wires to screw terminals.

Electrical wires are presently wrapped around terminals with a screwdriver and longnose pliers as follows:

1. A screwdriver is used to loosen the screw to its fullest open position.
2. Longnose pliers are employed to make a loop in the end of the wire.
3. The loop is placed under the head of the screw.
4. While holding the wire tightly against the screw with one hand, the loop is closed with the longnose pliers. This operation is awkward, especially if two or three wires are attached to the same screw terminal. The jaws of the pliers must be small and tapered almost to a point to go under the head of the screw. Therefore, they have limited strength and poor rigidity. The clamping or holding area between the jaws is very small so the jaws frequently slip off the wire. When this happens the handles snap together and often pinch the fingers or the palm of the hand.
5. The screw is then tightened with a screwdriver.

SUMMARY OF THE INVENTION

It is an object of the invention to provide a simple, safe, and effective method for securing a wire to a screw terminal.

It is another object of the invention to provide a method whereby a workman can make the same size loop each time.

Still another object of the invention is to provide a method allowing one to secure a wire to a screw terminal more quickly and efficiently.

With these and other objectives in mind, a method is provided which includes the following steps: (1) a wire is inserted within an aperture of a hollow shaft; (2) the wire or shaft is turned to form a loop in the wire; (3) the looped wire is withdrawn from the aperture and placed around the shaft of a screw of a screw terminal; (4) the loop is closed, and (5) the screw is tightened. By making the hollow shaft of correct diameter and inserting the wire until it contacts the side of the shaft opposite the aperture, the same size loop can be made each time. The aperture is preferably at right angles to the shaft to facilitate making the loop.

BRIEF DESCRIPTION OF THE DRAWINGS

FIGS. 3–10 illustrate the steps performed according to the method of the invention;

FIG. 11 illustrates a method for opening a loop in a wire,

DESCRIPTION OF THE INVENTION

Figure 1:
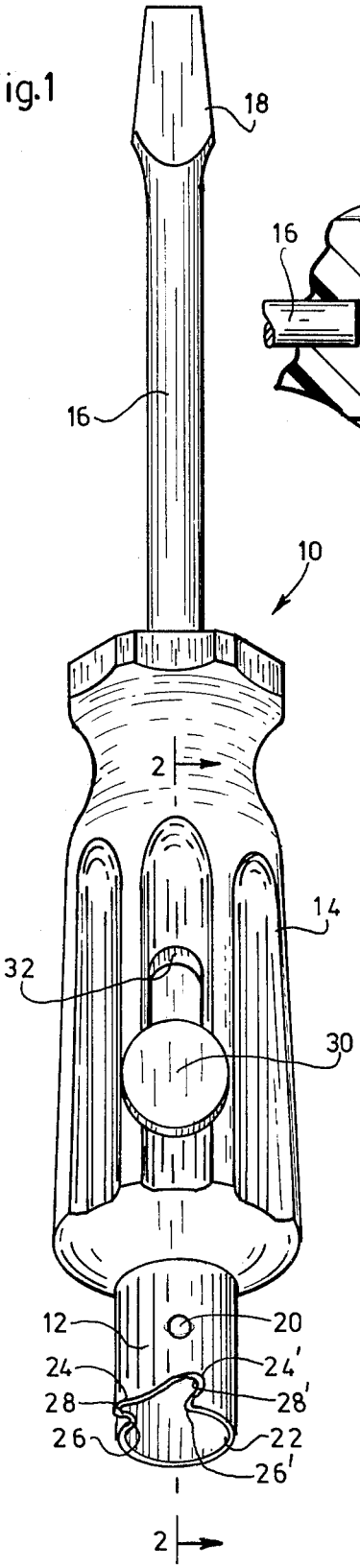
FIG. 1 is a perspective view of an apparatus adapted for performing the method of the invention.

FIG. 1 illustrates a tool 10 which is particularly well adapted for carrying out the steps of the invention in the most expedient manner. It includes a cylindrical shank 12 which extends from a handle 14. Extending from the other end of the handle is an ordinary metal shaft 16 with a head 18 for insertion in a screw groove. The cylindrical shank has a small hole or aperture 20 drilled or otherwise provided therein which is substantially normal to the shank. A larger opening 22 appears at the base of the shank so that it can be placed over the head of a screw. The opening has a depth of approximately 0.406 inches in this embodiment. The shank also has two notches 24 and 24' formed at its base. The notches include lower protruding portions 26, 26' and recessed arcuate portions 28, 28' adapted for receiving a wire. One of the notches is used to close a wire loop and the other to open it.

Figure 2:
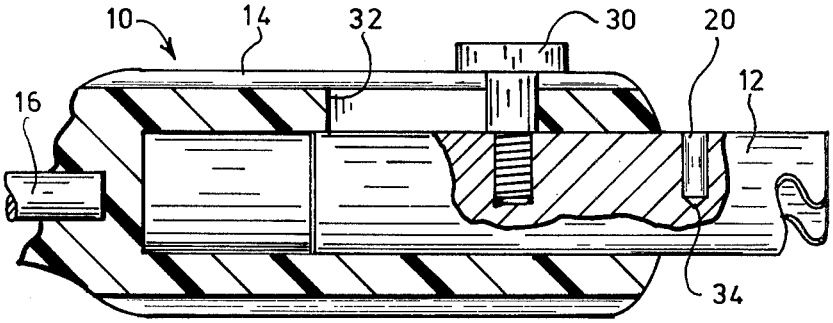
FIG. 2 is a sectional view taken along line 2—2 of FIG. 1.
Figure 3:
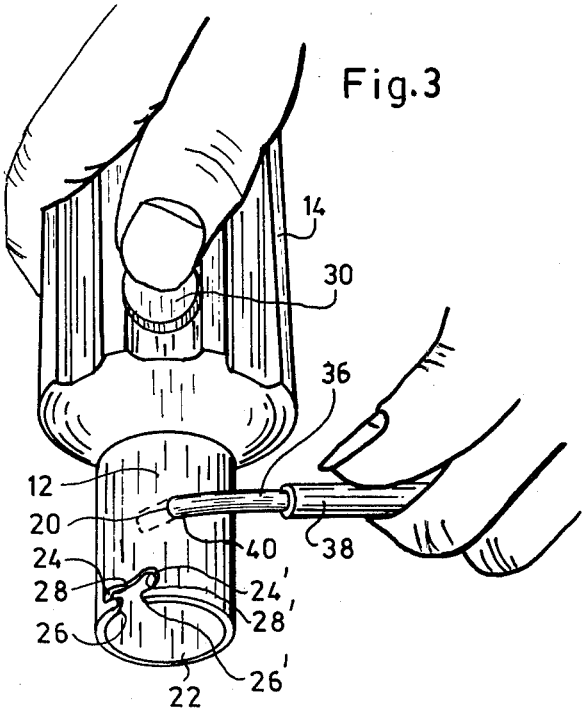

The shank 12 may be retractable within the handle 14, and can easily be extended to the operating position by pushing an attached thumb screw 30 which projects through a slot 32 in the handle. FIG. 2 is most illustrative of these features. The hole 20 is also provided with an end wall or stop 34, the function of which will later be explained. The depth of the hole 20 is between ⅜–7/16" in this example, and is provided within a shank 12 having a diameter of about 0.485 inches.

FIGS. 3–10 illustrate the steps of the invention utilizing the above described tool 10. It should be understood that the method is applicable for both heavy gauge wires (e.g. 12 and 14 gauge) and those of small diameter.

Figure 4:
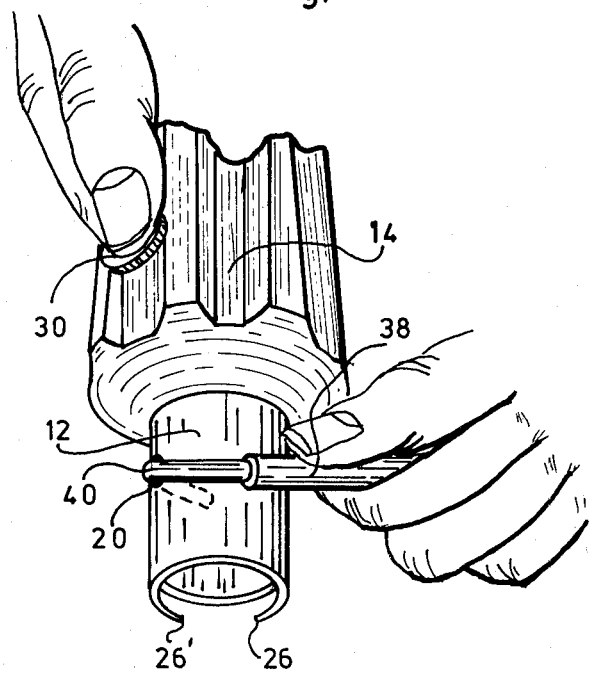

The stripped portion 36 of an insulated wire 38 is inserted within the hole 20 which is appropriately shaped for receiving it. The stop 34 insures that the same length of wire enters the hole each time it is used, and cylindrical side walls insure proper positioning. As shown in FIG. 4, the handle 14 and shank 12 of the tool 10 are twisted to provide an open loop 40 within the wire. The wire is then withdrawn from the hole in the condition shown in FIG. 5.

Figure 6:
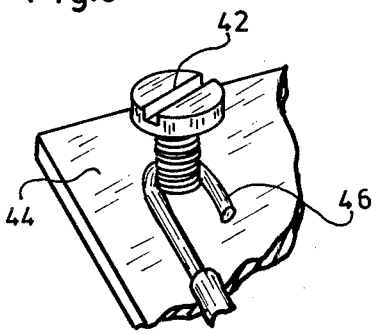

FIG. 6 illustrates the positioning of the open loop under the head of a screw 42 of a screw terminal 44. The shank 12 of the tool 10 is positioned over the screw and loop such that the straight portion 46 of the loop is engaged by one of the notches 24, 24'. The shank is then rotated as shown in FIG. 8 to close the loop. Alternatively, the tool may be held stationary while the wire is moved as in FIG. 9 to produce a slightly larger loop. It has been found that the motion shown in FIG. 8 is preferred because it makes a snug fit while leaving enough slack around the screw to allow the screw to be tightened without stripping the screw threads. A combination of rotating the tool and moving the wire opposite to the direction of rotation can be used to obtain the size loop desired.

FIG. 10 shows the tightening of the screw using the opposite end 18 of the tool 10.

To open the loop, the tool is tilted to position one of the notches 24, 24' within the loop. It is rotated counterclockwise to open the loop and allow the wire to be removed. (See FIG. 11).

Figure 12:
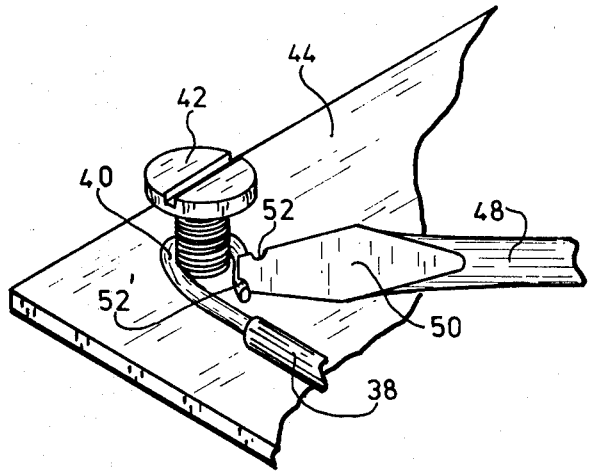
FIG. 12 shows the closing of a loop of relatively fine gauge wire.

FIG. 12 shows a device for closing the loop of 16 gauge and finer wire. The loop is formed in the same manner described above and positioned beneath the head of a screw. It will be appreciated that a hole of smaller diameter and depth should be used than for heavier wire as well as a smaller shank. A tool 48 having a head 50 resembling that of a screwdriver is provided. A pair of notches 52, 52' are provided on the head, each being about 1/16" wide and 1/16" deep. Their arcuate shape enables them to easily engage a wire. The loop is closed by pushing the tool or holding it stationary while pulling the wire.

Thus, the several aforenoted objects and advantages are most effectively obtained. Although several somewhat preferred methods have been disclosed and described in detail herein, it should be understood that the invention is in no sense limited thereby and its scope is to be determined by that of the appended claims.

What is claimed is:

1. A method for securing a wire to a screw terminal comprising the steps of:

providing a first tool having a hole of selected depth therein, the depth of said hole being defined by an end wall thereof;

inserting an end of a wire within said hole until it contacts said end wall;

rotating said wire with respect to said first tool to form an open loop in said wire;

removing said wire from said hole;

positioning said loop about a screw of a screw terminal;

closing said loop; and tightening said screw.

2. A method as described in claim 1 including the step of rotating said wire with respect to said first tool to form an open loop having a relatively straight end portion.

3. A method as described in claim 2 further including the step of providing a second tool having a notch therein of appropriate shape for engaging the wire, engaging the end portion with said notch; and moving said second tool thereby closing said loop.

4. A method as described in claim 3 wherein said second tool comprises a shank having an open end adapted for fitting over the screw of a screw terminal, said open end being provided with at least one notch, including the step of rotating said shank with respect to said screw to close the loop.

5. A method as described in claim 4 including the step of rotating said shank while moving the wire opposite to its direction of rotation to provide a loop of desired size.

6. A method as described in claim 3 wherein said first and second tools are combined in one instrument to facilitate securing the wire.

7. A method as described in claim 3 wherein said notch has an arcuate portion for engaging the wire.

8. A method as described in claim 1 wherein said hole has substantially cylindrical side walls.

9. A method as described in claim 1 wherein said hole is provided within a cylindrical shaft, and is substantial normal to said shaft.

* * * * *